US006672013B1

(12) United States Patent
Glassey et al.

(10) Patent No.: US 6,672,013 B1
(45) Date of Patent: Jan. 6, 2004

(54) METHOD OF INSTALLING ELEVATOR RAILS

(75) Inventors: Thomas E. Glassey, Plainville, CT (US); Leandre Adifon, Farmington, CT (US); Thomas Landry, Canton, CT (US); Bruce Swaybill, Farmington, CT (US); Richard Fargo, Plainville, CT (US); Jim Rivera, Bristol, CT (US); Bruce St. Pierre, Bristol, CT (US)

(73) Assignee: Otis Elevator Company, Farmington, CT (US)

( * ) Notice: Subject to any disclaimer, the term of this patent is extended or adjusted under 35 U.S.C. 154(b) by 618 days.

(21) Appl. No.: 09/705,077

(22) Filed: Nov. 2, 2000

(51) Int. Cl.[7] ..... B66B 9/00

(52) U.S. Cl. ..... 52/30; 187/406; 187/408; 187/411; 187/900

(58) Field of Search ..... 187/406, 407, 187/411, 900

(56) References Cited

U.S. PATENT DOCUMENTS 2,321,106 A * 6/1943 Sanford ..... 187/408
2,848,077 A * 8/1958 Tofanelli ..... 187/408
3,948,358 A * 4/1976 Atkey ..... 187/408
4,431,087 A * 2/1984 Karol ..... 187/408
5,520,264 A * 5/1996 Korhonen ..... 187/408
6,488,124 B1 * 12/2002 Yasuda et al. ..... 187/254

FOREIGN PATENT DOCUMENTS

EP 0688735 A2 6/1995
EP 0710618 A2 10/1995

* cited by examiner

*Primary Examiner*—Carl D. Friedman
*Assistant Examiner*—Steve Varner
(74) *Attorney, Agent, or Firm*—Carlson, Gaskey & Olds

(57) ABSTRACT

An improved method for mounting elevator rails within a hoistway includes the initial step of securing support brackets to a pair of rails. The brackets, rails, a machine for driving a cab and a dead end hitch are then mounted within the hoistway. A cab may then be moved vertically within the hoistway and additional support brackets are placed at vertically spaced locations. The connection of the brackets and rails provides support to dissipate the loads which are transferred into the rail in such systems wherein the machine or the dead end hitch is fixed to a rail. Once the rails have been adequately supported by additional brackets, the brackets which are secured to the rails are removed from the rail. The brackets provide support, but are no longer fixed to the rails.

6 Claims, 4 Drawing Sheets

METHOD OF INSTALLING ELEVATOR RAILS

BACKGROUND OF THE INVENTION

This invention relates to a method of installing the rails in an elevator shaft wherein the machine and the dead end hitch are mounted on the rails.

Elevator shafts are typically equipped with a number of rails to guide the components within the hoistway. In particular, one side of the elevator hoistway includes two spaced rails which together guide a counterweight. A cab rail is mounted inward of these two rails. A second cab rail is positioned on an opposed side of the hoistway. The two cab rails guide the cab within the hoistway.

Historically, a machine for moving the cab has been mounted in a machine room above the hoistway. A second component known as a dead end hitch provides a connection point for the cables or ropes which move the elevator. Typically, the dead end hitch has also been mounted in the machine room.

To mount elevator rails within the hoistway in the prior art, the rails are initially positioned within the hoistway. The machine is then used to drive a cab upwardly within the hoistway. As the cab is moved upwardly, brackets are placed at appropriate vertically spaced locations in the hoistway to guide and support each of the rails. On the side of the hoistway which includes the counterweight rails and one cab rail, a generally U-shaped bracket supports the three rails. On the opposed side, a simple clip bracket supports the other cab rail. The brackets are not fixed to the rails, but rather provide support. The walls of the building move relative to the rails as the building expands or contracts. Thus, the brackets are fixed to the walls of the hoistway, but merely guide the rails and are not typically fixed to the rails.

More recently, elevators have been designed wherein the machine and the dead-end hitch are fixed at the top of the rails. In this way, a more compact elevator assembly is provided since space above the hoistway is not required for the machine room. One complication with such an arrangement involves installing the rails. The machine will transfer the cab weight into the rails as the cab is moved upwardly within the hoistway. Until the rails are supported, they should not be called upon to bear the weight of the cab. Thus, complicated systems requiring additional means for moving the cab within the hoistway and mounting the brackets have been required when the machine and dead end hitch have been mounted to the rails.

It would be preferable to simplify the mounting of the rails into a hoistway in the type of elevator wherein the machine and/or the dead end hitch is mounted onto the rails themselves.

SUMMARY OF THE INVENTION

In a disclosed embodiment of this invention, a rail sub-assembly is mounted into one, and preferably both sides, of a hoistway. One rail sub-assembly includes the machine which is preferably mounted on the rails. A second sub-assembly includes a dead end hitch, also mounted onto the rails. The uppermost bracket is preferably fixed to the wall of the hoistway, and is also fixed to at least the cab rail. The cab is then moved vertically within the hoistway and the other brackets are mounted to the wall and to support the rails. Once the brackets are all in place, the rails are adequately supported. At that point, the connection of the upper bracket to the rail is removed. The rails are now all supported and can bear the cab weight. The present invention preferably uses the uppermost bracket; however, a bracket slightly lower may also be utilized. By fixing the bracket to the rail, the forces is transmitted through the bracket and into the wall, rather than into the unsupported rails. The ability of the building to expand or contract relative to the rail does not complicate this invention in that the connection is temporary.

In preferred embodiments of this invention, the bracket on the side having the counterweight rails is generally U-shaped, and has a central web extending between two spaced legs. A bolt extends through that central web into a cab rail. On the opposed side, a clip-like bracket is secured to the wall, and then bolted on a side of the rail. Again, each of these bolts are removed once the other brackets are in place.

These and other features of the present invention can be best understood from the following specification and drawings, the following of which is a brief description.

DETAILED DESCRIPTION OF A PREFERRED EMBODIMENT

Figure 1:
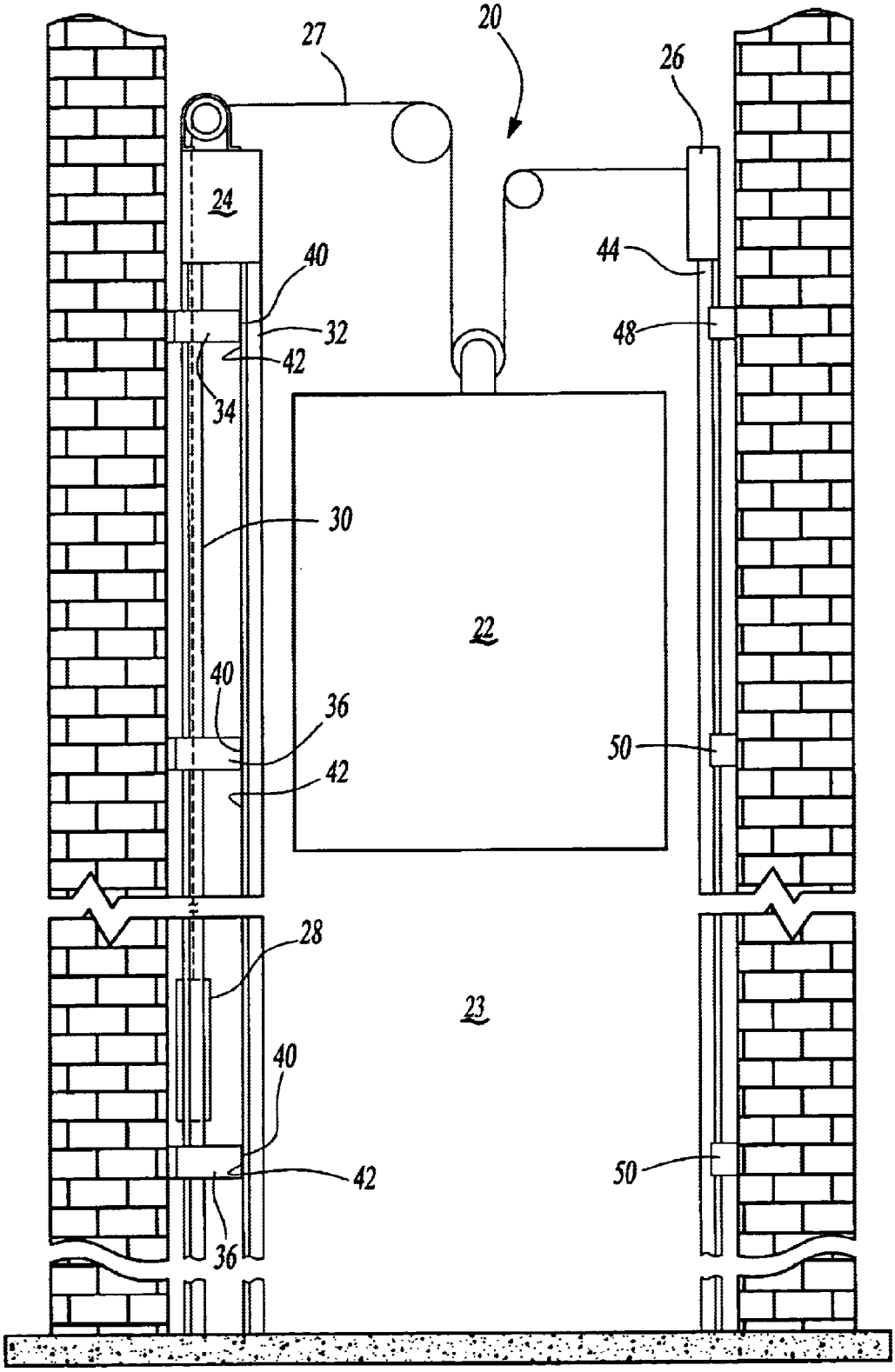
FIG. 1 schematically shows an elevator.

FIG. 1 shows an elevator 20 having a cab 22 movable within a hoistway 23. As known, a machine 24 drives the cab and a dead end hitch 26 secures one end of the cable 27. This structure is shown extremely schematically, and may be as known. As is also known, a counterweight 28 is movable between a pair of rails 30 (only one of which is shown in this figure). A cab rail 32 is positioned laterally inwardly from the rails 30. A plurality of brackets 34 and 36 are spaced vertically within the hoistway 23. The brackets are fixed to the wall and have legs which provide support for the rails 30, and further have a surface 40 providing support against surface 42 of the rail 32.

The opposed rail 44 has brackets 48 and 50 again spaced vertically. The brackets 34, 36, 48 and 50 are not fixed to the rails, but rather simply provide support. In this way, the building may expand and contract relative to the rails and the brackets will move with the building. However, the brackets do still provide adequate support.

As mentioned above, one problem with the system shown in FIG. 1 occurs when the machine 24 is mounted atop the rails 32 and 30, and/or when the dead end hitch 26 is mounted to the rail 44. In such a case, a force from the weight of the cab is transmitted into the rails when the cab is being moved. This is not an issue once the brackets are in place supporting the rails. However, it has typically been the case that the brackets are installed by moving the cab within the hoistway. This will not typically be practical when the machine 24 is mounted to the rails, and the dead end hitch 26 is mounted to the rail 44. Instead, other ways of moving the cab within the hoistway 23 have been proposed for elevators which have utilized rail mounted machines and/or dead end hitches.

Figure 2:
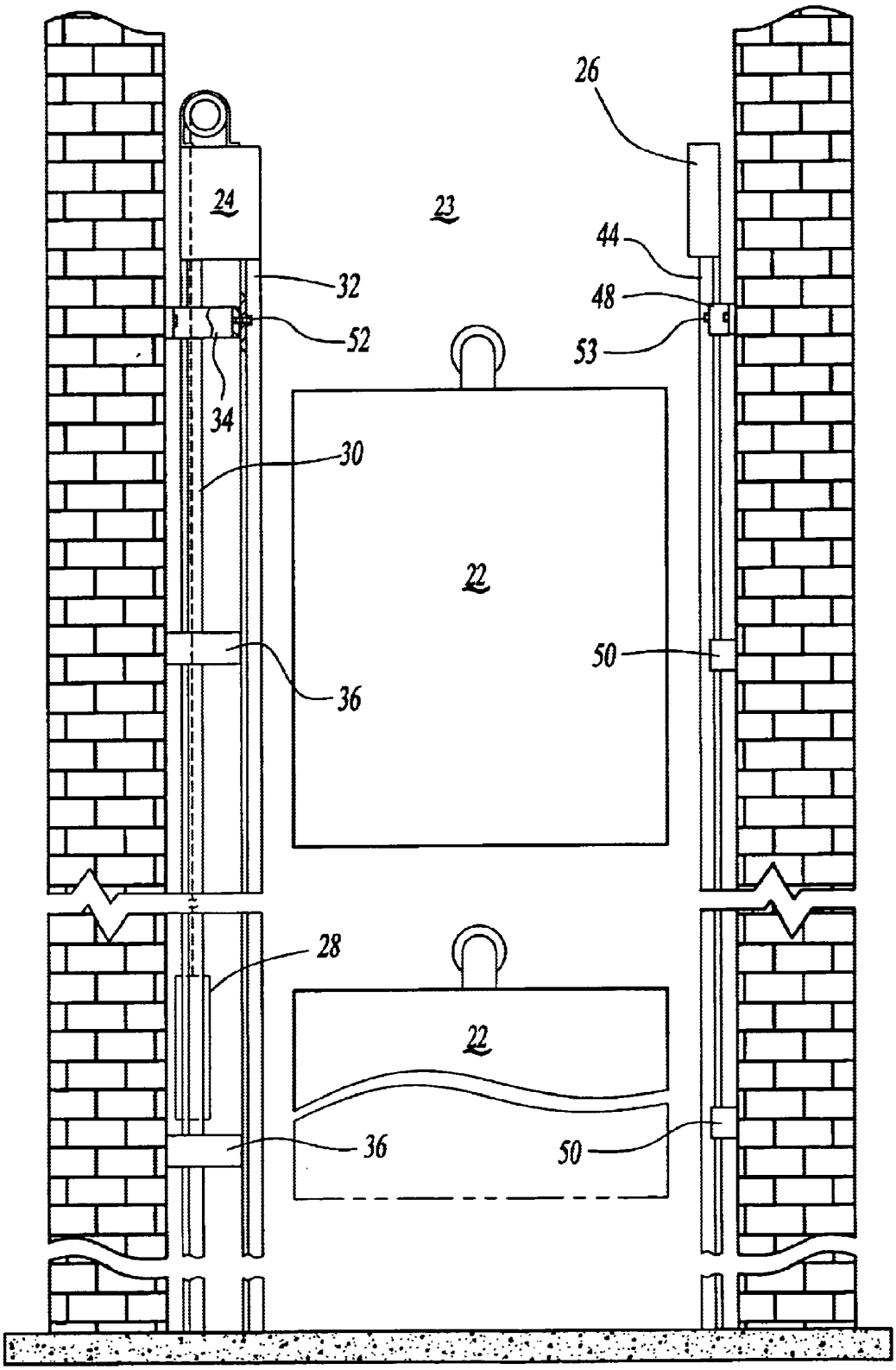
FIG. 2 schematically shows installation of the elevator.

The present invention provides a method of allowing movement of the cab within the hoistway to mount the brackets, and fully support the rails. As shown in FIG. 2, initially a rail and machine subassembly including the machine 24, rails 32 and 30, and the uppermost bracket 34 is inserted within the hoistway 23. Similarly, a rail and dead end hitch sub-assembly with the dead end hitch 26, rail 44 and bracket 48 are inserted into the hoistway. At the time, the other brackets 36 and 50 are not yet mounted within the building. As shown, a bolt 52 extends through the bracket 34 into the rail 32, and bolts 53 extend from the bracket 48 into the rail 44. When the cab 22 is moved upwardly, forces are transmitted from the machine 24 into the rail 32, and through its connection of the bolt 52 into the bracket 34. The bracket 34 is fixed to the wall of the hoistway, and thus the force is transmitted into the wall. Similarly, force from the dead end hitch is transmitted through the bracket 48 and bolts 53 to the wall. The cab may be moved vertically upwardly and the brackets 36 and 50 placed along the height of the hoistway.

Figure 3:
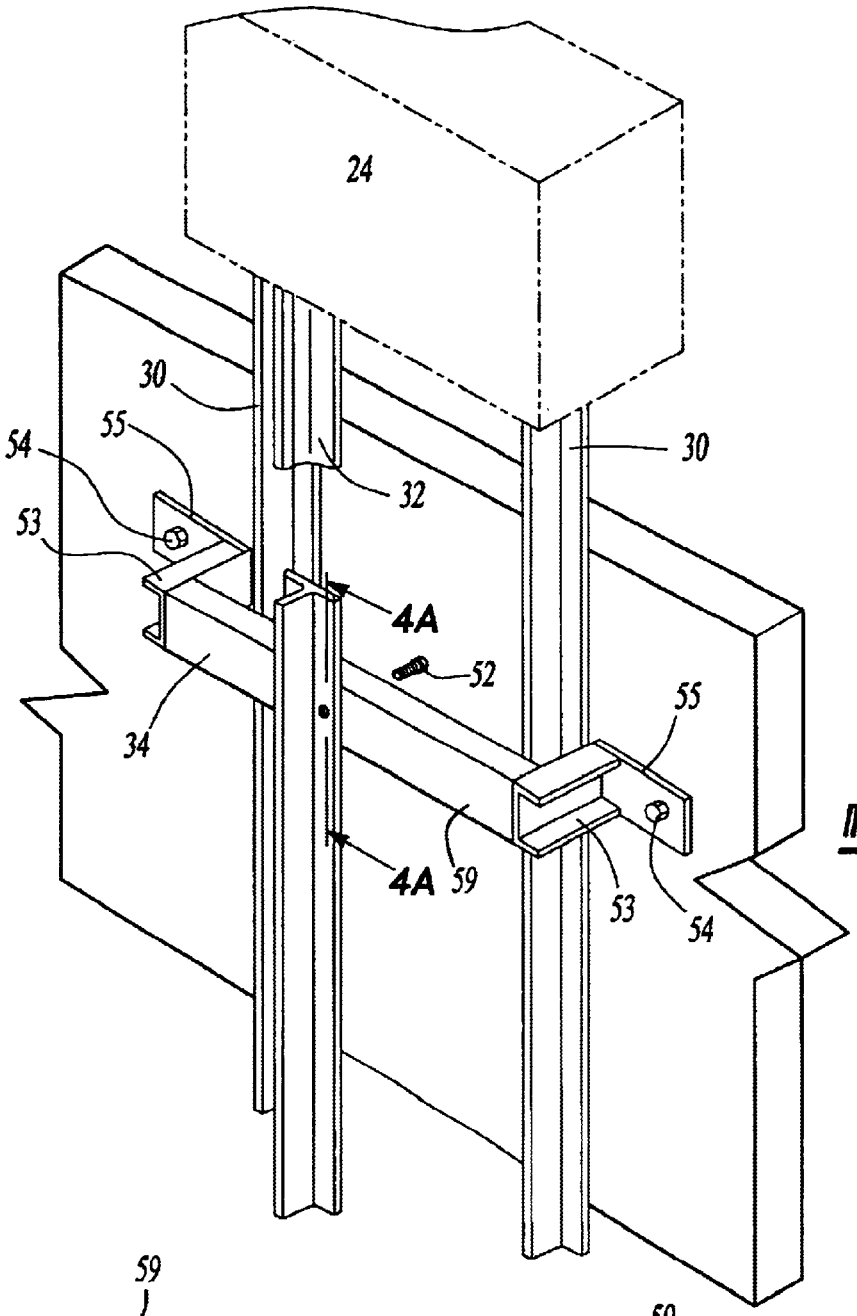
FIG. 3 shows one side of the elevator.

As shown in FIG. 3, the bracket 34 includes side legs 53 going to feet 55 which are bolted 54 to the wall. Once the elevator is fully installed, the brackets are bolted to the wall, and the legs 53 provide support for the rails 30. A web portion 59 provides support for the rail 32. However, as mentioned above, when the machine and rail subassembly is initially inserted into the hoistway the bolt 52 secures the bracket 34 to the rail 32.

Figure 4A:
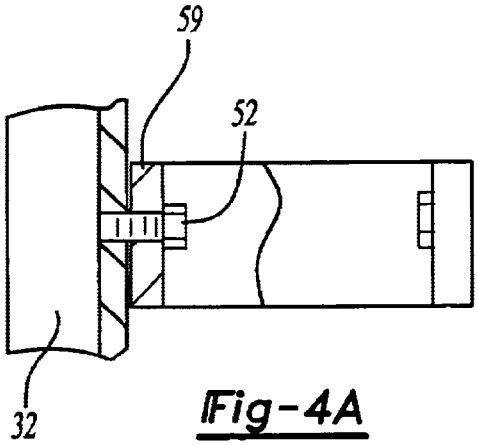
FIG. 4A shows a cross section along line 4A—4A of FIG. 3.

As shown in FIG. 4A, the web 55 carries the bolt 52, which is secured to the rail 32.

Figure 4B:
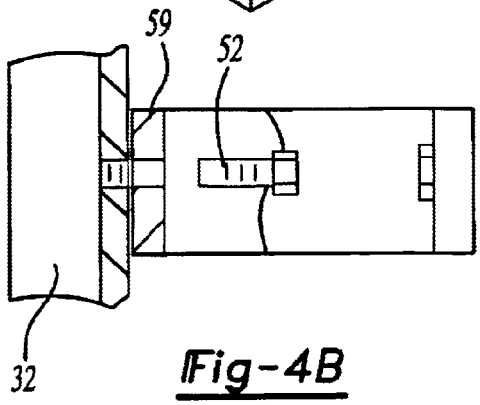
FIG. 4B shows a subsequent step.

As shown in FIG. 4B, once the other brackets are installed, the bolt 52 is removed, and the bracket 34 merely supports the rail 32, but is no longer fixed to the rail 32.

Figure 5:
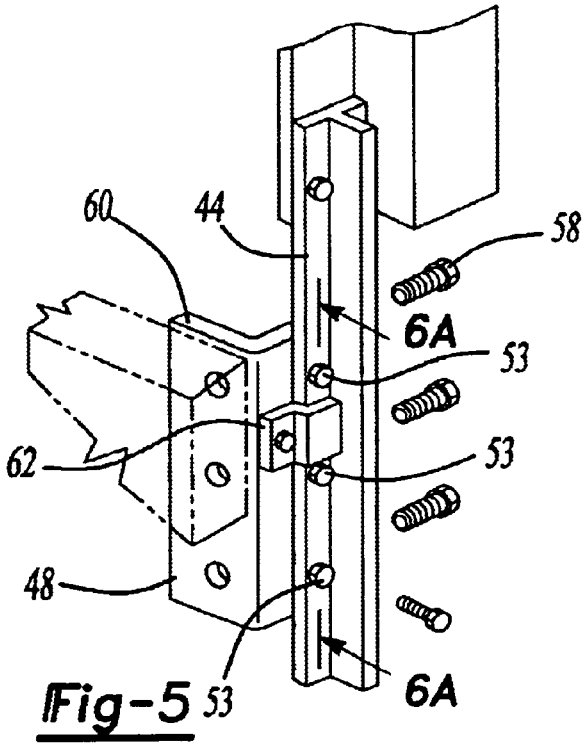
FIG. 5 shows the opposed guiderail.

Similarly, FIG. 5 shows the dead end hitch 26 fixed to the rail 44. The racket 48 includes a plurality of bolts 53 secured to a portion of the rail 44. A mount ledge 60 receives bolts 58 to secure the mount ledge to a wall. Clip 62 actually provides support to the rail 44 after installation.

Figure 6A:
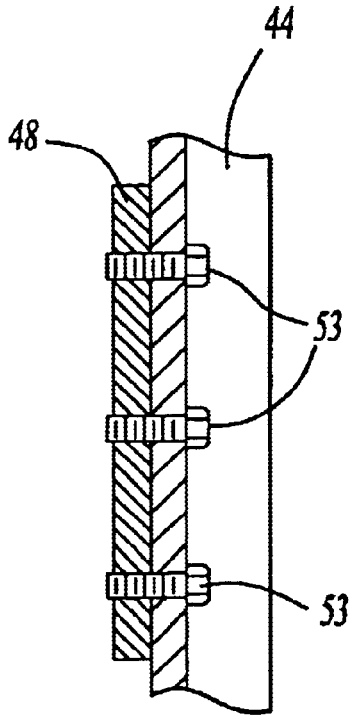
FIG. 6A is a cross-sectional view along line 6A—6A of FIG. 5.

As shown in FIG. 6A, the bolts 53 extend through the mount ledge 48 and into the rail 44.

Figure 6B:
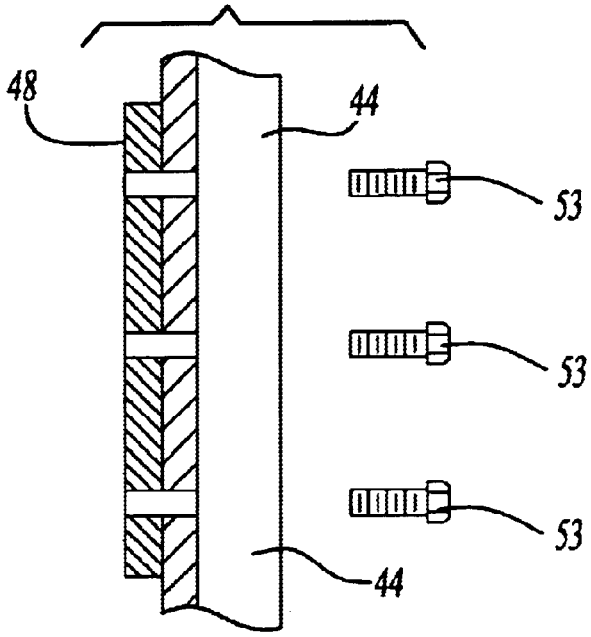
FIG. 6B shows a subsequent step.

As shown in FIG. 6B, once the elevator is fully installed, the bolts 53 are removed.

A preferred method of installing an elevator has been disclosed. A worker in this art would recognize that modifications of this invention would come within the scope of this application. For that reason, the following claims should be studied to determine the true scope and content of this invention.

What is claimed is:

1. A method of installing elevator rails within a hoistway comprising the steps of:

(1) providing a machine and rail sub-assembly including a machine mounted onto at least one rail, and providing a first bracket mounted at an upper half of said rail, said bracket being fixed to said at least one rail;

(2) securing said bracket to a wall of a building, while continuing to maintain said bracket fixed to said at least one rail;

(3) moving a cab upwardly by said machine through a hoistway and along said at least one rail, and securing additional brackets to said wall of said building in a position to support said at least one rail, but not being fixed to said at least one rail; and (4) then removing said connection of said at least one rail to said first bracket.

2. A method as set forth in claim 1, wherein said first bracket is an uppermost bracket.

3. A method as set forth in claim 1, wherein said first bracket is generally U-shaped, and a bolt extends through a central web of said U-shape to fix said bracket to said at least one rail.

4. A method as set forth in claim 1, wherein a dead end hitch is fixed to an opposed rail, and said dead end hitch is moved into said hoistway along with a second bracket fixed at an upper half of said opposed rail, said step (3) further including the step of attaching brackets to support said opposed rail, and said step (4), including the step of removing the connection between said second bracket and said opposed rail.

5. A method as set forth in claim 1, wherein said at least one rail is positioned on a side of said hoistway with three rails, with two of said three rails providing guidance for a counterweight and a third rail being said at least one rail, and supporting said cab.

6. A method of installing elevator rails within a hoistway comprising the steps of:

(1) providing a machine and rail sub-assembly including a machine mounted onto a first rail, and providing a first bracket mounted at an upper half of said first rail, said first bracket being fixed to said first rail, and providing a dead end hitch and rail-assembly including a dead end hitch mounted onto a second rail, and providing a second bracket mounted at an upper half of said second rail, said second bracket being fixed to said second rail;

(2) securing said first and second brackets to walls of a building, while continuing to maintain said brackets secured to said rails.

(3) moving a cab upwardly by said machine through a hoistway and along said rails, and securing additional brackets to said wall of said building, and in a position to support said rails, but not being fixed to said rails; and (4) then removing said connection of said rails to said first and second brackets.

* * * * *